United States Patent [19]

Marsh et al.

[11] Patent Number: 4,582,008

[45] Date of Patent: Apr. 15, 1986

[54] TIMING ARRANGEMENT FOR A SEWING MACHINE

[75] Inventors: Walter H. W. Marsh, Scotch Plains; John Patricia, Elizabeth, both of N.J.

[73] Assignee: The Singer Company, Stamford, Conn.

[21] Appl. No.: 722,768

[22] Filed: Apr. 16, 1985

Related U.S. Application Data

[63] Continuation of Ser. No. 557,772, Dec. 2, 1983, abandoned.

[51] Int. Cl.[4] ..... D05B 69/02; D05B 27/02

[52] U.S. Cl. ..... 112/220; 112/221; 112/323

[58] Field of Search ..... 112/182, 190, 220, 221, 112/314, 323

[56] References Cited

U.S. PATENT DOCUMENTS

| | | | |
|---|---|---|---|
| 368,925 | 8/1887 | Angell | 112/323 |
| 428,508 | 5/1890 | Merrow | 112/116 |
| 1,145,620 | 7/1915 | Seymour | 112/323 |
| 1,363,140 | 12/1920 | Merritt | 403/33 |
| 2,392,793 | 1/1946 | Wood | 112/220 |
| 3,023,722 | 3/1962 | Johnson | 112/314 |
| 3,408,970 | 11/1968 | Kakinuma | 112/245 |
| 4,428,316 | 1/1984 | Patricia et al. | 112/323 |
| 4,474,124 | 10/1984 | Yamazawa | 112/221 X |

OTHER PUBLICATIONS

Bricker, *Automobile Guide,* Audel & Co., Indianapolis, Ind., 1969, p. 590.

*Toyota,* Chilton Book Co., Philadelphia, Pa., 1970, p. 25.

*Primary Examiner*—Wm. Carter Reynolds

*Attorney, Agent, or Firm*—Robert E. Smith; David L. Davis; Edward L. Bell

[57] ABSTRACT

In a sewing machine, needle bar and take-up motion is timed to feed dog motion through a constant breadth cam and gear in predetermined angular positions on the arm shaft, a gear on a vertical shaft in mesh with the arm shaft gear according to timing marks on the gears, and a lift cam in a predetermined angular position on the vertical shaft relative to the gear thereon.

4 Claims, 5 Drawing Figures

TIMING ARRANGEMENT FOR A SEWING MACHINE

This is a continuation of co-pending application Ser. No. 557,772, filed on Dec. 2, 1983, now abandoned.

BACKGROUND OF THE INVENTION

1. Field of the Invention

The invention is directed to an arrangement for timing needle bar and take-up motion to feed motion in a sewing machine.

2. Description of the Prior Art

Sewing machines have been designed to enable timing adjustments to be made at the factory and in the field for the purpose of properly correlating the motions of the variour stitch forming instrumentalities. However, timing adjustments at the factory are time consuming, and have proved costly. Further, the timing devices built into the machines have added to the cost of manufacture and could not always be relied upon to maintain a machine properly timed over a protracted period of time after having been set.

It is a prime object of the invention to enable a needle bar and take-up during the assembly of a sewing machine to be automatically timed to a feed dog without the need for a modulating type adjustment.

It is also an object of the invention to simplify the mechanism for timing the needle bar and take-up of a sewing machine to a feed dog.

It is another object of the invention to eliminate the need to adjust the timing of the needle and take-up of a sewing machine to the feed dog after assembly.

Other objects and advantages of the invention will become apparent during a reading of the specification taken in connection with the accompanying drawings.

SUMMARY OF THE INVENTION

The horizontal arm shaft of a sewing machine with a crank thereon for a needle bar and take-up has a constant breadth cam and gear affixed thereto. The cam which serves to control back and forth movements of a feed dog is secured to the arm shaft in a defined predetermined angularly oriented position relative to the crank. The angular orientation of the gear on the arm shaft locates a timing mark on the gear at a predetermined angular location relative to the crank. Another gear which is affixed to a vertical shaft and includes a timing mark is engaged by the arm shaft gear in a meshing relationship defined by the timing marks on the two gears. A lift cam is secured to the vertical shaft in a defined predetermined angularly oriented position relative to the gear thereon. As a consequence of the described relationships, needle bar and take-up movements are automatically timed to back and forth as well as up-down movements of the feed dog of the machine.

DESCRIPTION OF THE PREFERRED EMBODIMENT

Figure 1:
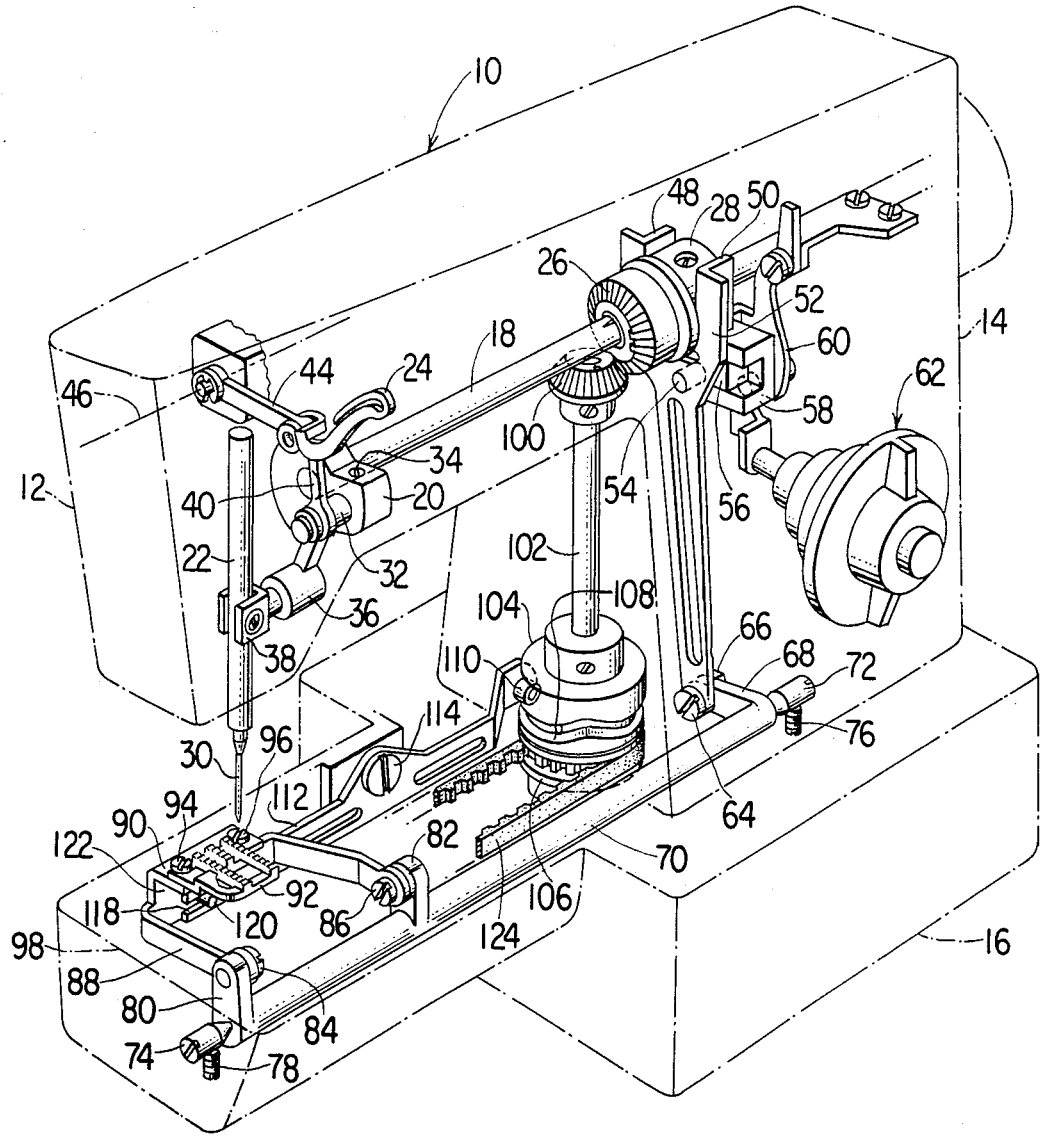
FIG. 1 is a somewhat schematic perspective view showing mechanism for driving a needle bar, take-up and feed dog of a sewing machine according to the invention.

Referring to FIG. 1 of the drawings, a sewing machine 10 is shown in phantom as including a bracket arm 12, a standard 14, and a base 16. A horizontal arm shaft 18 which may be driven in any of the many ways well known in the sewing machine art is located in the bracket arm. Such arm shaft 18 has a crank 20 for a needle bar 22 and thread take-up member 24 affixed to one end of the shaft, and a composite bevel gear 26 and cam 28 affixed to the other end thereof.

Needle bar 22 carries a needle 30, and is reciprocated endwise by arm shaft 18 acting through crank 20, a stub shaft 32 affixed to the crank with set screw 34, a link 36 pivotable on the stub shaft, and a needle bar collar 38 to which link 36 is attached. A link 40 may be seen as including take-up member 24 at one end. Link 40 is pivoted at one end on stub shaft 32 and is pivotably connected as shown to one end of a link 44 that is pivotable at its opposite end about a fixed axis 46 in the machine. Rotation of arm shaft 18 results in link 40 being driven by crank 20, and the link 40 being guided in its motion by link 44 imparts reciprocating up down motion to take-up member 24.

Cam 28 of the combined gear and cam at the opposite end of shaft 18 from crank 20 is shown as a constant breadth cam, that is as a cam of constant thickness which smoothly shifts its position from predominantly on one side of the axis of the horizontal arm shaft 18 to the other side thereof. Cam 28 is spanned by the tines 48 and 50 of a sheet metal feed fork 52, the tines being flanged to provide enlarged cam engaging bearing surfaces as shown. A pin 54 extends from fork 52 and into a slide block 56 which is captured in the slide of a feed regulator 58 pivotally carried in the sewing machine 10. Also shown, is a feed regulator lever 60 having a pivotal connection to the feed regulator 58 and actuatable by a feed regulator control assembly 62 to change the cant of the feed regulator 58 so as to vary the feed advance as is well known in the sewing machine art.

The lower end of fork 52 is pivotally connected by a screw 64 and nut 66 to an arm 68 of a rock shaft 70 supported on bullet centers 72 and 74 which are retained in the proper position in the frame of the sewing machine 10 by set screws 76 and 78, respectively. The rock shaft 70 oscillates in response to the up and down motion imparted thereto by fork 52 by virtue of its connection to the slide block 56 set in the feed regulator 58. The rock shaft 70 is fashioned with a pair of upright rock arms 80 and 82 which are connected by screws 84 and 86 to the opposite extremes of a U-shaped sewing machine feed dog carrier 88. The feed dog carrier 88 is formed with a horizontally extending shelf 90 to which a feed dog 92 is attached by the screws 94 and 96. The feed dog 92 is moved back and forth in the bed 98 of the machine in response to the oscillation of rock shaft 70.

Bevel gear 26 on horizontal arm shaft 18 is engaged by a bevel gear 100 on one end of a vertical shaft 102. A lift cam 104 and toothed pulley 106 are affixed to the opposite end of shaft 102. As shown, cam 104 includes a cam track 108 wherein a follower 110 is received. The follower extends from one end of a lift lever 112 which which is pivoted at 114 in the bed of machine 10. The lift lever is slotted at 118 at the opposite end from follower 110 to receive a stud 120 which projects from a downward extension 122 of the U-shaped feed dog carrier 88. Vertical shaft 102, cam 104 and pulley 106 are rotated by arm shaft 18 acting through meshing bevel gears 26 and 100. Pivotal movement is imparted to lever 112 by the cam track 108 acting through follower 110, and the lever acting upon stud 120 causes up down movement to be imparted to feed dog 92. A belt 124 on pulley 106 operably connects with a looptaker (not shown) and imparts rotation thereto. The pulley is suitably secured to shaft 102 as with a screw 125.

Figures 2, 3, 4, 5:
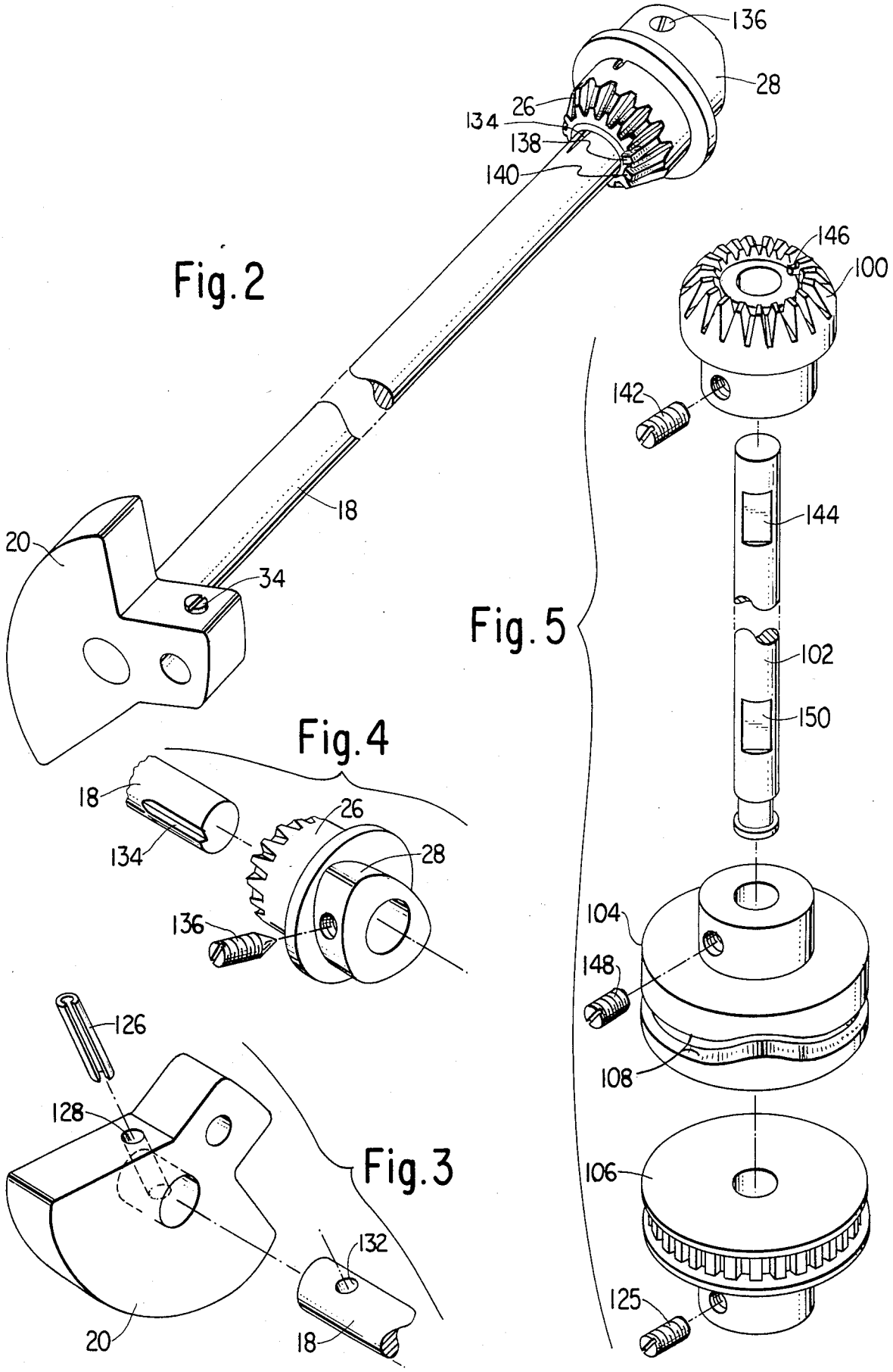
FIG. 2 is a perspective view of the arm shaft of the machine.
FIG. 3 is an exploded perspective view showing the manner in which a needle bar and take-up crank is attached to the arm shaft.
FIG. 4 is an exploded perspective view showing the manner in which a composite gear and cam is attached to the arm shaft.
FIG. 5 is an exploded perspective view of a vertical shaft included in an operative connection between the arm shaft and feed dog of the machine.

Crank 20 is affixed to arm shaft 18 with a pin 126 which is force fitted in aligned holes 128 and 132 in the crank and shaft respectively, (see FIG. 3). Shaft 18 has a longitudinally extending V-shaped groove 134 formed therein at the opposite end from the crank attached end, and the composite gear 26 and cam 28 is attached to the shaft with a cone point set screw 136 extending into the groove (see FIG. 4). The relative disposition of hole 132 and groove 134 circumferentially in shaft 18 is predetermined to time cam 28 and thereby the back and forth motion of feed dog 92 with respect to crank 20, the needle bar 22 and take-up 24.

Two adjacent teeth of gear 26 are inwardly extended to provide timing marks 138 and 140 in predetermined angular positions on the gear relative to crank 20 in the secured position of composite gear 26 and cam 28. Gear 100 is affixed with a set screw 142 to a flat 144 on an upper end portion of vertical shaft 102, and has a raised timing mark 146 thereon which is located between the timing marks 138 and 140 on gear 26 when the gears 26 and 100 are initially meshed during assembly of the machine. Cam 104 is secured with a set screw 148 to a flat 150 on a lower end portion of shaft 102. The cam profile is thereby angularly related in a predetermined manner to gear 100 as required to automatically time up down motion of feed dog 92 with respect to reciprocating motion of the needle bar and take-up as well as back and forth motion of the feed dog.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. In a sewing machine, a horizontal arm shaft with a needle bar and take-up crank secured thereto; a composite gear and cam affixed to the arm shaft, cooperating locating means in said crank and said arm shaft and in said composite gear and cam and said arm shaft for locating the cam in only one predetermined angularly oriented position relative to the crank, the gear having a timing mark thereon in a predetermined position relative to the crank; a feed dog; mechanism operably connecting the cam to the feed dog for imparting back and forth movement to the feed dog in timed relationship to movement of the crank upon rotation of the arm shaft; and other mechanism operably connecting said gear to the feed dog for imparting up down movement to the feed dog in timed relationship to movement of the crank and the back and forth movement of the feed dog; said other mechanism including a vertical shaft, another gear with a timing mark secured to the vertical shaft and in mesh with the gear on said composite gear and cam according to the timing marks on the gears, and a lift cam affixed to the vertical shaft, cooperating locating means in said another gear and said vertical shaft and in said lift cam and said vertical shaft for locating the lift cam in only one predetermined angularly oriented position relative to said another gear.

2. The combination of claim 1 wherein at least one of said cooperating locating means includes a timing groove formed in the associated shaft, and a cone pointed set screw engaging said timing groove to establish said only one predetermined angularly oriented position.

3. The combination of claim 1 wherein at least one of said cooperating locating means includes a flat formed on the associated shaft, and a single set screw engaging said flat to establish said only one predetermined angularly oriented position.

4. The combination of claim 1 wherein at least one of said cooperating locating means includes a transverse hole formed in the associated shaft and a pin force fit into said hole to establish said only one predetermined angularly oriented position.

* * * * *